US005167792A

United States Patent [19]

Kamitakahara et al.

[11] Patent Number: 5,167,792

[45] Date of Patent: Dec. 1, 1992

[54] MASTER HOLDER OF STAMPER ELECTROFORMING APPARATUS AND ELECTROFORMING METHOD

[75] Inventors: Hirofumi Kamitakahara; Naoki Kushida, both of Yokohama; Hitoshi Yoshino, Kawasaki; Osamu Kanome, Yokohama; Hisanori Hayashi, Kawasaki, all of Japan

[73] Assignee: Canon Kabushiki Kaisha, Tokyo, Japan

[21] Appl. No.: 809,138

[22] Filed: Dec. 18, 1991

[30] Foreign Application Priority Data

Dec. 19, 1990 [JP] Japan ..... 2-403554

[51] Int. Cl.[5] ..... C25D 1/10; C25D 17/06

[52] U.S. Cl. ..... 205/68; 204/297 R

[58] Field of Search ..... 205/68; 204/297 R

[56] References Cited

FOREIGN PATENT DOCUMENTS 58-141435 9/1983 Japan .

61-284843 12/1986 Japan .

*Primary Examiner*—T. M. Tufariello

*Attorney, Agent, or Firm*—Fitzpatrick, Cella, Harper & Scinto

[57] ABSTRACT

Disclosed are a master holder of a stamper electroforming apparatus and an electroforming method using this master holder. The master holder is for use in a stamper electroforming apparatus that forms a metal film by electroforming on a conductive film formed on a master having a minute relief pattern on its surface; and this master includes: a contact ring for electrically connecting the conductive film to a power source; and a structure for controlling the rate at which the metal film is formed, which structure is provided on the contact ring and adapted to control the metal-film-formation rate such that the thickness of a peripheral portion of the metal film gradually decreases in the vicinity of the contact ring.

35 Claims, 9 Drawing Sheets

MASTER HOLDER OF STAMPER ELECTROFORMING APPARATUS AND ELECTROFORMING METHOD

BACKGROUND OF THE INVENTION

1. Field of the Invention

This invention relates to a master holder used in the production of stampers for molding optical recording mediums used to record and reproduce information optically, and to an electroforming method using this master holder.

2. Description of the Related Art

Conventionally, the recording of various kinds of information has been effected by using magnetic materials, such as magnetic tapes or magnetic discs, various types of semiconductor memories or the like. While they provide the advantage of easy writing and reading of information, these magnetic and semiconductor memories have certain problems; for example, they allow rewriting of information too easily and are incapable of high-density recording.

To eliminate these problems, an optical information-recording method using optical recording mediums has been proposed as a means of treating various kinds of information effectively; and, as means to be employed in this method, there have been proposed optical information record carriers, recording/reproduction methods, and recording/reproduction apparatuses. In an optical recording medium, serving as an information recording carrier, the recording or reproduction of information is generally effected by virtue of differences in optical reflectance levels, transmittance levels or the like on the surface of the medium's optical recording layer; such differences are caused by partly volatilizing the optical recording layer, causing changes in the reflectance thereof, or deforming the layer, by means of a laser beam. After information has been written to this optical recording layer, it requires no processing, such as a development processing; it is a so-called DRAW (direct read after write) medium which allows "direct reading after writing". Since this optical recording layer allows high-density recording and, further, additional writing, it is effective as an information recording/storage medium.

An optical recording medium generally in use has a pre-format, such as tracking grooves and/or pre-pits, on the surface of its substrate, which substrate is formed, for example, by compression molding, a 2P-method, or injection molding. No matter how this substrate is formed, a stamper is used to transfer a relief pattern on the order of submicrons onto a plastic material, such as a polycarbonate plastic or a polymethyl methacrylate plastic. Such a stamper has conventionally been produced, for example, by the method disclosed in Japanese Utility Model Laid-Open No. 58-141435 or in Japanese Patent Laid-Open No. 61-284843, or, by the method described in "Outline of Optical Disc Processing Technique No. 5" (Nippon Kogyo Gijutsu Center, Mar. 15, 1985).

An outline of a method of producing stampers will be described in detail with reference to FIGS. 5(A) to 5(E). First, a photoresist layer 8 is formed on the surface of a glass substrate 9 (FIG. 5(A)); then, exposure and development processes are performed on the photoresist layer 8 in a pattern corresponding to the pre-format concerned, which pattern is in the form of tracking grooves, information pits, or the like, thereby obtaining a master 6 having a photoresist pattern 8' on its surface (FIG. 5(B)).

Next, a conductive film 11 is formed on the surface of the master 6 (FIG. 5(C)), and then a metal film 12 is formed on the film 11 by electroforming (FIG. 5(D)). After polishing the surface of the metal film 12, the conductive film 11 and the metal film 12 are separated as a whole from the master 6, whereby a stamper 13 for molding information recording mediums is obtained (FIG. 5(E)).

Concerning the generally used method of producing information-recording-medium molding stampers, which has been described above schematically, the steps of FIGS. 5(C) and 5(D) will be explained in more detail. The conductive film 11 is formed, for example, by vacuum deposition of a metal, or by sputtering; this film may be made of silver or, more commonly, nickel. This conductive film, consisting, e.g., of nickel, is formed to a thickness of 500 to 1000Å on the microscopic photoresist pattern 8', which corresponds to the format concerned, which is in the form of tracking grooves, information pits, or the like.

During the electroforming process of FIG. 5(D), the master 6, on which the conductive film 11 has been formed, is held by a master holder; and the electroforming on the master is effected by means of an electroforming apparatus as shown in FIGS. 6(A) and 6(B). The master 6 is turned at a revolving speed of 20 to 30 rpm in a nickel-sulfamate electroforming solution 7, whereby a nickel film is formed on the master 6, on which the conductive film 11 has previously been formed. This process will be illustrated with reference to FIG. 6(A) and 6(B) which show sectional views of an electroforming apparatus. As shown in FIG. 6(A), electricity is first supplied to the nickel-sulfamate electroforming solution 7, with nickel chips 10 being used as the anode and a dummy plate 14 of a highly conductive material, such as copper, as the cathode; whereby the surface oxide of the nickel chips 10 is removed and, at the same time, the nickel-sulfamate electroforming solution 7 is cleaned electrolytically.

Next, as shown in FIG. 6(B), the master 6, with the conductive film 11 formed thereon, is held by a master holder 15 and turned in the nickel-sulfamate electroforming solution 7 at a revolving speed of 20 to 30 rpm, and, while the master 6 is thus being turned, electricity is supplied to the solution, with the nickel chips 10 being used as the anode and the master 6 as the cathode. By this electroforming process, a nickel film is deposited on the master 6 on which the conductive film 11 has previously been formed.

The master holder 15, which is used for the purpose of holding the master 6, with the conductive film 11 formed thereon, is of two types. In the first type, which is shown in FIG. 4(A), a contact ring 18, which serves to transmit electric current from a power source to the conductive film 11, is formed such that it comes in contact with the outer edge portion of the conductive film 11; in the second type, which is shown in FIG. 4(B), the contact ring 18 is in contact with the inner edge portion of the conductive film 11, with electric current from the electrical power source being supplied to the conductive film 11 through a conductor member 19 and the contact ring. In either case, the contact ring must be made of a material having a high conductivity so as to enable the conductive film 11 to be supplied with electric current; generally, copper or a thin plate of SUS is adopted as the material of the contact ring.

A problem with the above-described conventional master holders is that the copper or the thin plate of stainless steel (for example, SUS, or the like) (both have a high conductivity) is partly exposed to the electroforming solution, with the result that a nickel film is also deposited on and adheres to the outer and inner walls of the contact ring. This leads to the problems described in the next paragraph.

As shown in FIGS. 7(A) and 7(B), the metal (nickel) film 12 deposited on the master 6 by electroforming is in such a close contact with the contact ring, as indicated at 17 in the drawings, that, when the master 6 is being released from the holder, the contact ring cannot be easily detached from the metal film 12, with the result that the metal film 12 and the conductive film 11 are partly separated from the substrate 9, as shown in FIG. 9. Thus, in the subsequent polishing process, in which the metal film deposited on the master by electroforming is polished, those sections where such a separation has occurred are exposed to the intrusion of the polishing liquid, with the result that the microscopic relief pattern of the information-recording-medium molding stamper, which is in the form of tracking grooves, information pits, or the like, is impaired.

According to a conventional method, this problem is coped with by using a master having approximately double the size of the effective portion of the stamper (the portion corresponding to the microscopic relief pattern in the form of tracking grooves, information pits, or the like) so that the polishing-liquid intrusion does not reach this effective portion. The trouble with this arrangement is that the unnecessary master portion has to be removed by trimming in the final step and disposed of. This is uneconomical.

Further, with this method, one contact ring can only be used for a single electroforming, which is disadvantageous in terms efficient use of the contact ring and thus in terms of production cost.

According to another method which has been proposed with a view to prevent the metal film from depositing on and adhering to the contact ring, the contact ring 18 is covered with a non conductor material 3, as shown in FIG. 10. A problem with this method is that, as shown in FIG. 8, cracks 5 are generated in those portions of the conductive film 11 which correspond to the interface between the metal film 12 and the non-conductive material 3. Thus, in the subsequent polishing process, the polishing liquid is allowed to intrude through these cracks 5, impairing the minute pattern on the stamper. This seems to be attributable to the fact that the thickness of that portion of the metal film 12 which is in the vicinity of the non-conductor material 3 is particularly large, and, it is considered that due to the deposition of this thick-walled film portion, the stresses of the metal film are locally concentrated in the conductive film 11, causing cracks to be generated therein.

SUMMARY OF THE INVENTION

The present invention has been made in view of the above problems; it is an object of this invention to provide a master holder for a stamper electroforming apparatus which helps to prevent the contact ring and the metal film from sticking to each other so that the conductive film may not be separated from the master when the contact ring is being detached from the master.

Another object of the present invention is to provide a stamper electroforming method which makes it possible to form the metal film without allowing it to adhere to the contact ring and without involving the generation of cracks in the conductive film.

In accordance with the present invention, there is provided a master holder in a stamper electroforming apparatus for electroforming a metal film on a conductive film provided on a master having a minute relief pattern on its surface, the master holder comprising a contact ring for electrically connecting the conductive film to a power source to effect electroforming and a means provided on the contact ring to control the rate for forming the metal film.

The present invention further provides a stamper electroforming method, which comprises electroforming a metal film on a conductive film provided on a master having a minute relief pattern on its surface, wherein the metal film is formed by employing a master holder in accordance with the present invention, whereby the thickness of the metal film gradually decreases in the direction of the contact ring.

In accordance with the present invention, there is still further provided a master holder in a stamper electroforming apparatus for electroforming a metal film on a conductive film provided on a master having on its surface a relief pattern corresponding to information recorded on a recording medium, the master holder comprises a contact ring for electrically connecting the conductive film to a power source to effect the electroforming; and a means provided on the contact ring to decrease the film formation rate of the metal film in the vicinity of the contact ring.

In accordance with this invention, the rate at which the metal film is formed on the conductive film is controlled such that the amount of metal film deposited decreases in the vicinity of the contact ring, thereby preventing the metal film from adhering to the contact ring and, further, avoiding the generation of cracks in the conductive film.

Although it has not yet been clarified on what makes it possible to prevent the generation of cracks in the conductive film, it is considered that it is due to the fact that the film formation can be effected such that the metal-film deposit amount gradually decreases to enable the stress strain of the metal film to be dispersed.

DESCRIPTION OF THE PREFERRED EMBODIMENTS

The present invention will now be described in detail with reference to the accompanying drawings.

Figure 1:
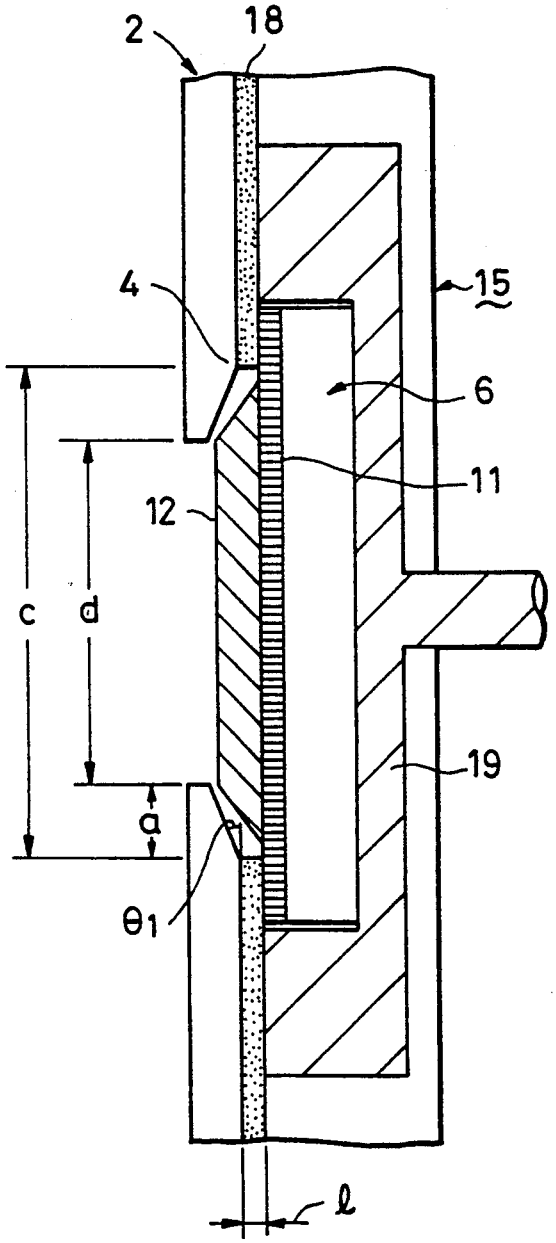
FIG. 1 is a schematic sectional view of a master holder having a film-formation-rate controlling means in accordance with an embodiment of this invention.
Figure 2:
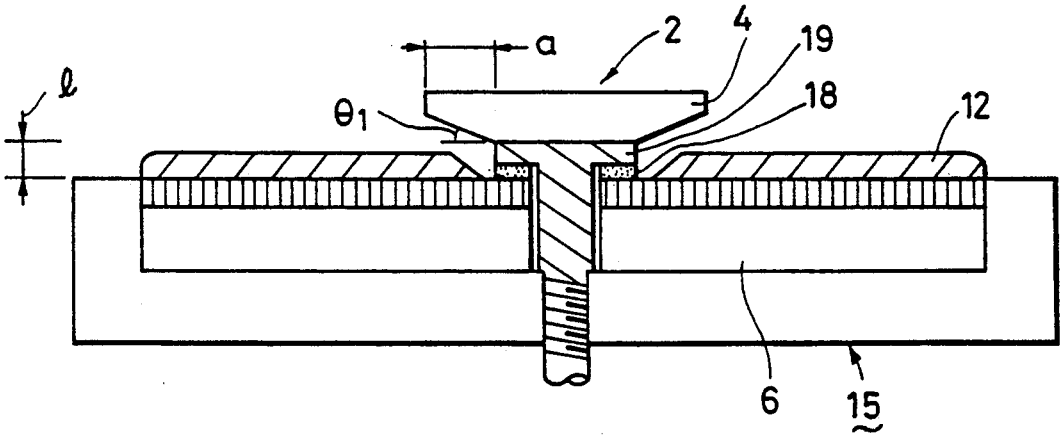
FIG. 2 is a schematic sectional view of a master holder having a film-formation-rate controlling means in accordance with another embodiment of this invention.

FIGS. 1 and 2 are schematic drawings showing sectional views of master holders in accordance with this invention with masters attached thereto; each master holder has a film-formation-rate controlling means. In each of the drawings, reference numeral 6 indicates a master which is obtained by forming a minute relief pattern corresponding to tracking grooves, information pits, or the like on the surface of a substrate. Reference numeral 11 indicates a conductive film, which serves as an electrode when electroforming is being performed; reference numeral 12 indicates a metal film formed on the conductive film 11 by electroforming; reference numeral 18 indicates a contact ring for electrically connecting the conductive film 11 to an electrical power source; and reference numeral 2 indicates an insulator member, which constitutes the means for controlling the rate at which the metal film 12 is formed. The contact ring 18 of the master holder shown in FIG. 1 is in contact with an outer edge portion of the conductive film 11 so as to allow the conductive film to be supplied with electric current from the power source. The contact ring 18 of the master holder shown in FIG. 2 is in contact with an inner edge portion of the conductive film 11.

In the master holder of this invention, it is desirable that the film-formation-rate controlling means be one which reduces the metal-film-formation rate in the vicinity of the contact ring. For example, in the case of the master holder of FIG. 1, the rate at which a portion of the metal film 12 which is in the vicinity of the contact ring 18 is formed can be gradually reduced by the insulator member 2, which has an opening (d) smaller than an opening (c) of the contact ring 18 and is stacked on the contact ring 18 in such a manner that the respective centers of their openings, (c) and (d), coincide with each other. Due to this arrangement, it is possible for the thickness of a portion of the metal film 12 to be gradually tapered in the direction of the contact ring 18. Thus, metal film deposition on the contact ring can be avoided and, further, stress strain of the metal film 12 applied to the conductive film 11 can be dispersed, thereby preventing the generation of cracks in the conductive film 11.

Further, when, as in the case of the master holder of FIG. 1, the sectional configuration of an inner edge portion of the insulator member 2 is tapered such that its opening (d) becomes wider in the depth direction, a turbulence of the metal ion current in the electroforming solution can be avoided, whereby the thickness of a portion of the metal film 12 other than that portion in the vicinity of the contact ring 18 can be made uniform and, at the same time, the thickness of that portion of the metal film 12 which is in the vicinity of the contact ring 18 can be gradually diminished. This arrangement is particularly effective in preventing the generation of cracks in the conductive film 11. In the case of the master holder shown in FIG. 2, the same effect can be obtained by means of the insulator member 2 having an outside dimension larger than that of the contact ring 18; the insulator member 2 is arranged above the contact ring with a conductor member 19 therebetween in such a manner as to protrude outwardly beyond the contact ring. In particular, by forming the protruding edge portion 4 of the insulator member 2 with a tapered sectional configuration such that its outside dimension decreases in the depth direction, it is possible to form a metal film 12 having a uniform thickness on a section of the conductive film 11 which is other than the conductive film section in the vicinity of the contact ring 18; further, this arrangement helps to effectively prevent the generation of cracks in the conductive film 11.

In this invention, it is desirable that a length (a) of the protruding edge portion 4 of the insulator member 2, constituting the film-formation-rate control means, be 5 to 30 mm and, more preferably, 5 to 10 mm. Further, it is desirable that an angle $\theta_1$ defined by the interface between the contact ring 18 and the insulator member 2, and the tapered edge portion of the insulator member, be 45° or less, more preferably, 5° to 30°, and, most preferably, 5° to 10°.

Further, in the case of FIG. 1, a length l, which is the distance between the surface of the conductive film 11 and the interface between the insulator member 2 and the contact ring 18, is 1 mm or less and, more preferably, determined as: 0.05 mm$\leqq$0.5 mm. In the case of FIG. 2, where the insulator member 2 is formed above the contact ring 18 with the conductor member 19 therebetween, this length l is defined as the distance between the surface of the conductive layer 11 and the interface between the insulator member 2 and the conductor member 19, with the preferable range thereof being the same as in the case of FIG. 1.

When the length (a), angle $\theta_1$, and distance 1, defined above, are respectively in the above-mentioned ranges, it is possible to make the thickness of that portion of the metal film 12 which is in the vicinity of the contact ring such that the stress strain of the metal film applied to the conductive film can be effectively dispersed; further, metal film deposition on the contact ring can be avoided, and a satisfactory level of electroforming efficiency can be obtained.

Further, in the case of the insulator member 2 shown in FIG. 1, the maximum value of the width of its opening is made equal to the size of the opening (c) of the contact ring; and, in the case of the insulator member shown in FIG. 2, the minimum value of its outside dimension is made equal to the outer dimension of the contact ring 18. These arrangements are preferable in that the metal film 12 can be formed closer to the contact ring without allowing it to stick to the contact ring, thus attaining a further improvement in terms of electroforming efficiency. Further, in the case of the master holder of this invention shown in FIG. 1, it is desirable that the contour of the opening d of the insulator member 2 be the same as that of the opening (c) of the contact ring 18, and, in the case of the master holder shown in FIG. 2, it is desirable that the outer contour of the insulator member 2 be the same as that of the contact ring 18. The thickness of the insulator member 2 is preferably in the range of 10 to 50 mm and, more preferably, in the range of 10 to 25 mm; with this thickness level, the rigidity of the insulator member can be so maintained that the ion current is not hindered by this member.

The insulator member of the present invention can be made of any material as long as it is an insulator. For example, it may be hard vinyl chloride, acrylic vinyl chloride, or the like.

Other embodiments of the master holder of this invention will be described with reference to FIGS. 3(A) and 3(B).

Figure 3A:
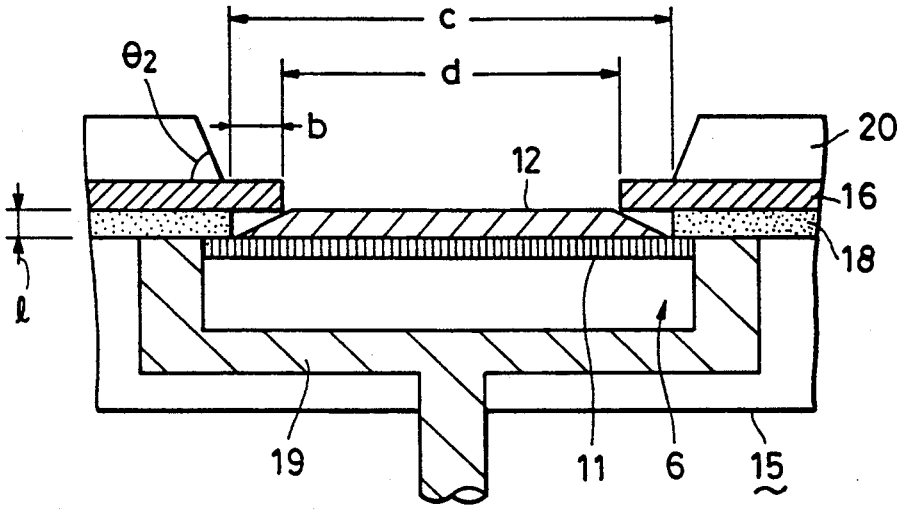
FIGS. 3(A) and 3(B) are schematic sectional views of a master holder having a film-formation-rate controlling means in accordance with still other embodiments of this invention.

The master holder 15 shown in FIG. 3(A) includes an insulator sheet 16 having an opening at its center and serving as the means for controlling the metal-film-formation rate in the vicinity of the contact ring, and a cover 20 for retaining this insulator sheet on the master holder. The opening (d) of the insulating sheet 16 is smaller than the opening (c) of the contact ring 18; and, the insulating sheet is stacked on the contact ring in such a manner that the respective centers of their openings (c) and (d) coincide with each other.

Figure 3B:
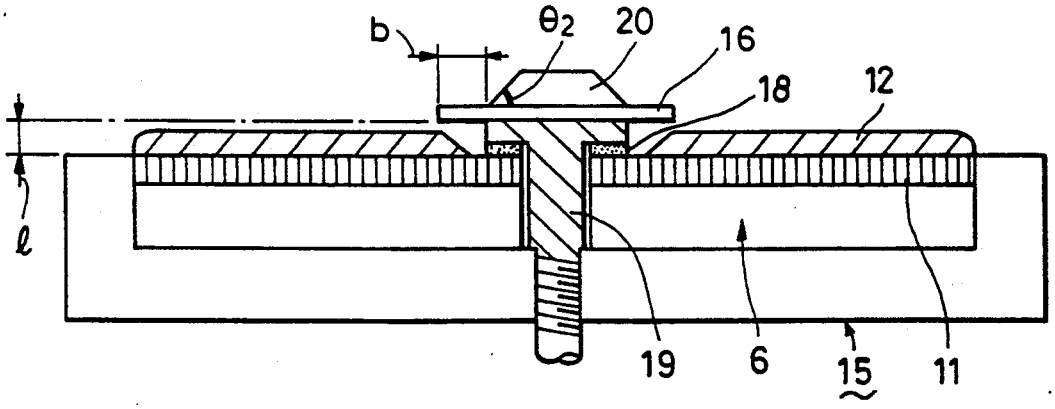
Figure 4:
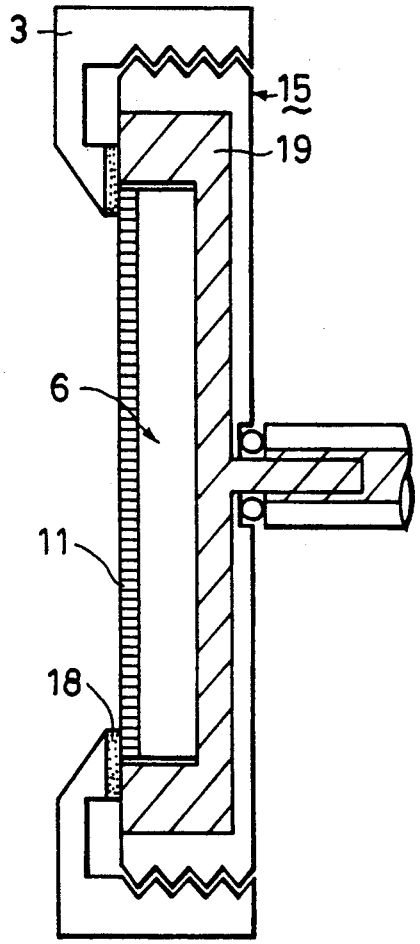
FIG. 4 (A) PRIOR ART
FIGS. 4(A) and 4(B) are sectional views of conventional master holders.
Figure 4:
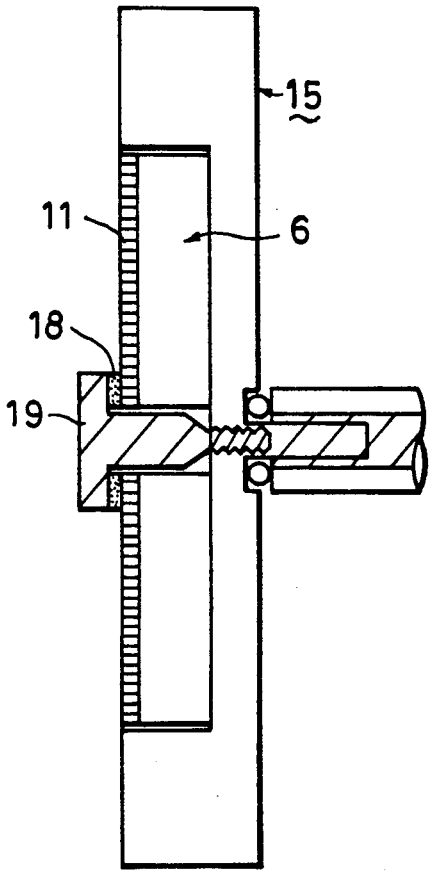
FIG. 4 (B) PRIOR ART
Figure 5A:
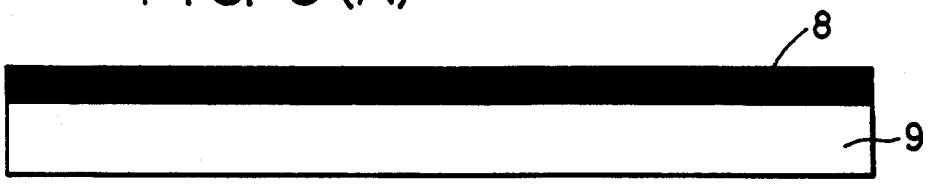
FIGS. 5(A) to 5(E) are process drawings showing an electroforming method for producing a stamper for molding information recording mediums.
Figure 5B:
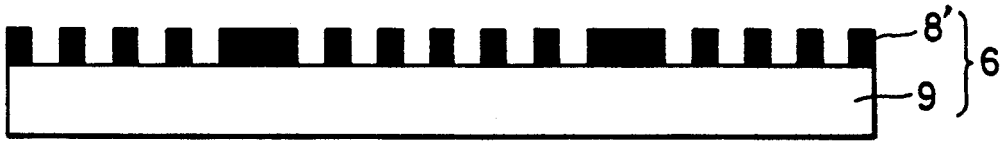
Figure 5C:
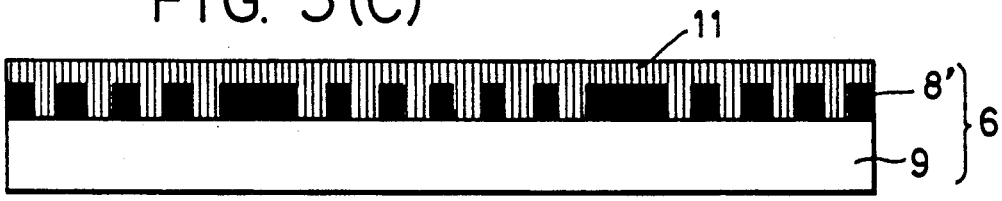
Figure 5D:
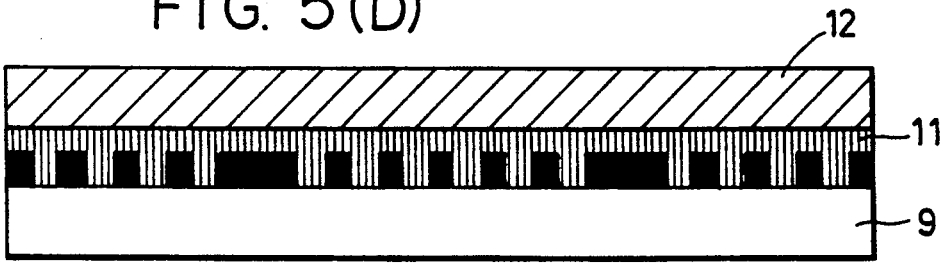
Figure 5E:
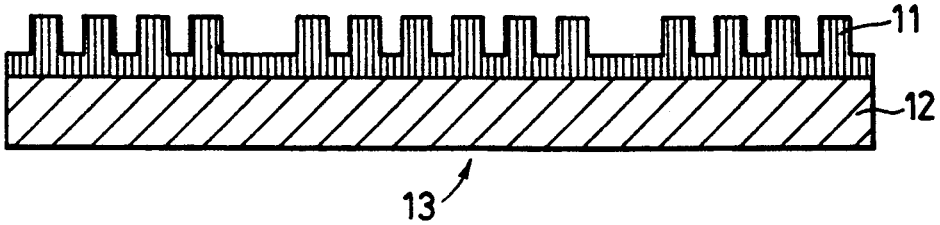

In the master holder shown in FIG. 3(B), which is of the type in which the contact ring 18 is in contact with the inner edge portion of the conductive film 11, an insulator sheet 16 is used as the insulator member for controlling the film formation rate of that portion of the metal film 12 which is in the vicinity of the contact ring. This insulator sheet is fastened to the contact ring 18 through a conductive member 19 by using a cover 20. The outer dimension of the insulator sheet 16 is larger than that of the contact ring, so that the insulator sheet protrudes outwardly beyond the contact ring.

Due to the construction in which the insulator sheet 16 protrudes inwardly or outwardly beyond the contact ring, the metal-film-formation rate can be reduced in the vicinity of the contact ring so that the thickness of the metal film gradually decreases in the direction of the contact ring, thereby preventing the metal film from sticking to the contact ring; further, the stress strain of the metal film applied to the conductive film 11 can be dispersed. It is desirable that the length of the protruding portion (b) of the insulator sheet 16 be in the range of 5 to 15 mm and, more preferably, in the range of 5 to 7 mm.

In these embodiments, it is desirable that the length 1, which is the distance between the surface of the conductive film 11 and the interface between the insulator sheet 16 and the contact ring 18, or the distance between the surface of the conductive film 11 and the interface between the insulator 16 and the conductor member 19, be 1 mm or less and, more preferably, determined as: $0.05\ \text{mm} \leqq 1 \leqq 0.5\ \text{mm}$.

If the thickness of the insulator sheet 16 is set in the range of 0.5 to 2 mm and, more preferably, in the range of 0.5 to 1 mm, the thickness of the metal film portion in the vicinity of the contact ring can be reduced more gradually and, at the same time, the thickness of the metal film portion other than that portion in the vicinity of the contact ring can be made more uniform, without disturbing the ion current in the electroforming solution during electroforming. Further, it is also possible to form on the insulator sheet 16 a cover of an insulator material for retaining the insulator sheet on the master holder. In that case, it is expedient to form an edge portion of this cover with a tapered sectional configuration. The angle of this tapered portion, $\theta_2$, is preferably 10° to 70° and, more preferably, 30° to 45°; and the thickness of the cover is preferably 10 to 50 mm and, more preferably, 10 to 25 mm.

The material of the insulator sheet used as the insulator member is preferably one which can maintain the requisite level of rigidity with a small thickness; examples of the material include: acrylic resins, phenol resins, vinyl chloride resins, ceramic materials, or the like.

Next, the stamper electroforming method of this invention will be described.

Figure 6:
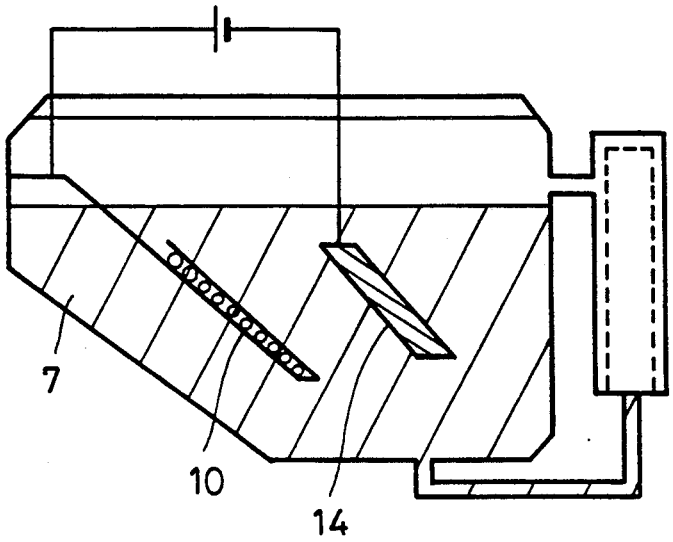
FIGS. 6(A) and 6(B) are schematic sectional views of an electroforming apparatus.
Figure 6:
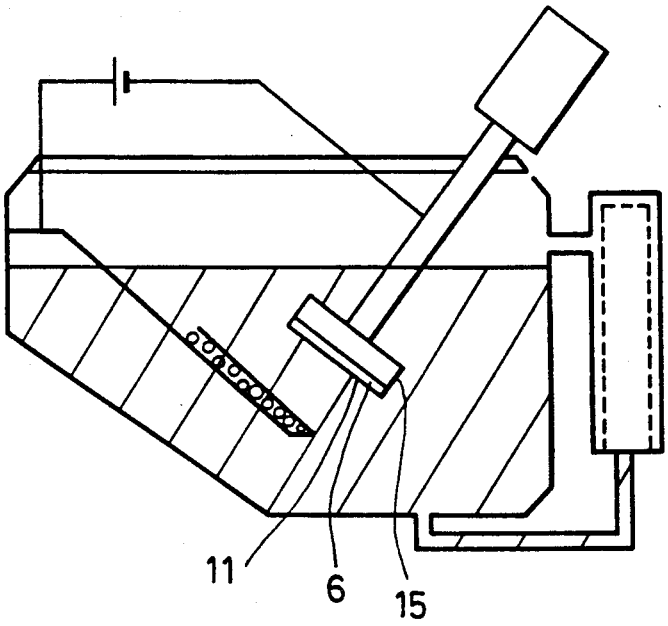
Figure 7A:
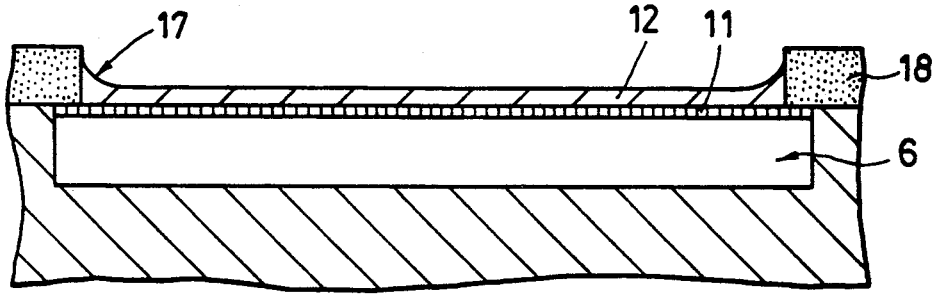
FIG. 7(A) PRIOR ART
FIGS. 7(A) and 7(B) are schematic sectional views of conventional master holders, showing how the metal film sticks to the contact ring.
Figure 7B:
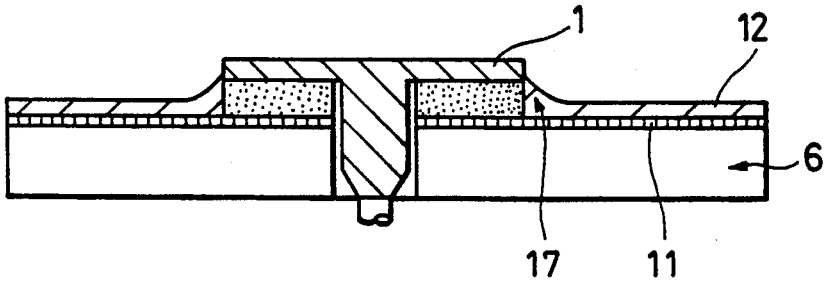
FIG. 7(B) PRIOR ART
Figure 8:
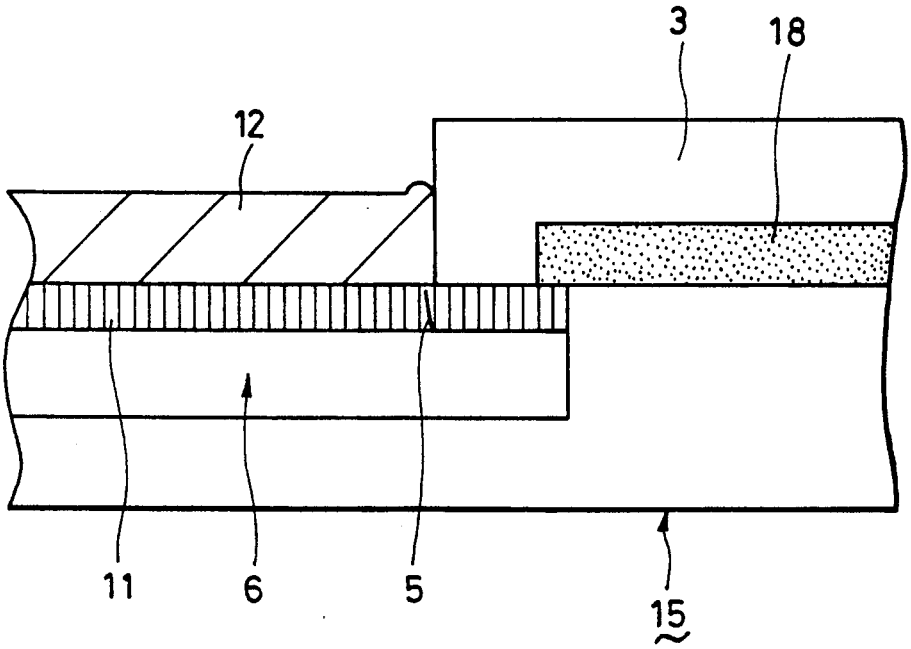
FIG. 8 PRIOR ART
FIG. 8 is a schematic sectional view showing how a metal film is formed by using a conventional master holder equipped with a contact ring of a type which is covered with a non-conductor material.
Figure 9:
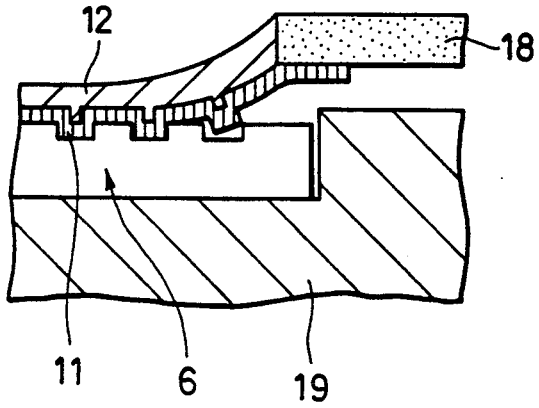
FIG. 9 PRIOR ART
FIG. 9 is a drawing illustrating a condition in which the contact ring is being removed from the master holder, with the metal film adhering to the contact ring.

According to the electroforming method of this invention, ordinary electroforming is performed on a glass master with a conductive film formed thereon by using an electroforming apparatus as shown in FIGS. 6(A) and 6(B) equipped with a master holder in accordance with this invention, which has a means for metal-film-formation-rate control means, with the glass master being held by the master holder. By this electroforming, a metal film is formed on the conductive film in such a manner that the thickness of the metal film portion in the vicinity of the contact ring gradually decreases in the direction of the contact ring.

In the present electroforming process, the revolving speed of the master holder is set to 50 rpm or less and, more preferably, 20 to 30 rpm; the amount of electricity supplied and the length of time the electricity supply is continued are determined such that the current-supply value as integrated with respect to time is in the range of 150 to 300 AH, causing a metal film having a thickness of 100 to 200 μm to be deposited in the section other than that in the vicinity of the contact ring. The type of electroforming solution used varies depending upon the kind of metal film to be deposited; when, for example, a nickel film is to be deposited, a nickel sulfamate electroforming solution or the like is used. After a metal film has been thus formed on the conductive film, the master is released from the master holder to polish the surface of the metal film, and then the metal film is detached from the glass master, whereby a stamper is obtained.

The present invention, which is applicable to the production of stampers for molding various kinds of object, is particularly effective in producing stampers for molding optical recording mediums. Any flaw on the relief pattern of a stamper for molding optical recording medium causes a serious problem since it will result in a defect in the optical recording mediums which are to be produced by transferring the pattern thereto. A pre-format information pattern previously formed by means of a stamper, such as tracking grooves for a record reproduction laser beam, is formed on such optical recording mediums.

Such tracking grooves constitute a very minute pattern, formed spirally, concentrically, or in parallel, in a width of 0.5 μm to 2 μm and a pitch of 1.0 to 5 μm, or, in a width of 2 to 5 μm and a pitch of 4.8 to 15 μm. Such relief patterns corresponding to the pre-format information are subject to the generation of flaws. In accordance with the present invention, the metal film, formed on the conductive film by electroforming, does not stick to the contact ring, so that no interface separation occurs between the metal film and the conducive film when the contact ring is being detached from the master. Accordingly, the intrusion of polishing liquid does not occur during the subsequent process in which the surface of the metal film is polished, thus protecting the relief pattern from damage. Further, the formation of the metal film is effected in such a manner that the thickness of the metal-film portion in the vicinity of the contact ring gradually decreases, whereby the stress strain of the metal film applied to the conductive film can be dispersed, thus avoiding the generation of cracks in the conductive film. Accordingly, the relief pattern on the surface of the stamper can be protected from destruction which would be otherwise caused by the intrusion of the polishing liquid into such cracks during the polishing process. Thus, it is possible to produce a high precision stamper having no defect.

As described above, the master holder of the instant invention helps to prevent the deposition of metal film on those conductive members which are exposed to the electroforming solution; this provides the following advantages:

(1) When the contact ring is being detached from the master after the deposition of metal film by electroforming, the metal film and the conductive film are not separated from the master; otherwise, the polishing liquid would intrude through the sections where such separation occurs, thereby impairing the minute relief pattern, which is in the form of tracking grooves, information pits, or the like;

(2) The size of the glass master can be made substantially equal to that of the effective portion (the minute relief pattern in the form of tracking grooves, information pits), so that an improvement can be attained in terms of efficiency in electroforming, thereby making it possible to produce stampers for molding information recording mediums at a lower cost;

(3) The same contact ring one electroforming, thereby attaining an improvement in terms of the efficient of use of the contact ring and also in terms of production cost; and (4) The thickness of the metal film portion in the vicinity of the contact ring can be diminished, so that it is possible to disperse the stress applied to the conductive film, thereby preventing the generation of cracks in the conductive film; otherwise, the polishing liquid would intrude in such cracks during the polishing process, thereby impairing the minute pattern of the stamper.

EXAMPLES

The following examples serve to describe the present invention in more detail and to further illustrate certain preferred embodiments and are no limitative of scope.

EXAMPLE 1

An appropriate amount of an ultraviolet curing resin (INC118 manufactured by Nippon Kayaku) was applied dropwise to the relief-pattern-formation surface of a photomask (manufactured by HOYA) on which has been previously formed a relief pattern exhibiting a pitch of 12 μm, a width of 3.0 μm, and a depth of 3000 Å and corresponding to stripe-shaped tracking grooves for an optical card. Next, a glass substrate having a thickness of 10 mm and a size of 300 mm×340 mm was placed on the ultraviolet curing resin thus applied and an appropriate pressure was applied such that the ultraviolet curing resin was spread evenly between the photomask and the glass substrate. When the ultraviolet curing resin attained a uniform thickness of 50 μm, it was subjected to light irradiation to cause it to cure. Afterwards, the photomask was detached from the resin, whereby a master was obtained. Subsequently, a nickel film was formed on the master to a thickness of 1000 Å by sputtering to obtain a master 6 having a conductive film 11 thereon.

In the subsequent electroforming process, the master 6, on which the conductive film 11 had been formed, was held by a master holder 15 as shown in FIG. 1 and, while it was being turned in a nickel-sulfamate electroforming solution 7 at a revolving speed of 20 to 30 rpm, electricity was supplied to the solution in a time-integrated current-supply amount of 160 to 240 AH (ampere·hour), thereby depositing nickel to a thickness of 200 to 300 μm to form a metal film 12.

The contact ring used in this example had a thickness of 0.5 mm and a diameter of 480 mm; it had a rectangular opening having a size of 290 mm×330 mm.

The insulator member 2 had a diameter of 550 mm and a thickness of 20 mm; the size of its opening was 270 mm×310 mm. The opening of the insulator member was formed such as to become wider in the direction of its depth. Specifically, the inner wall of the insulator member was tapered such that the size of the opening of the insulator member 2 and that of the opening of the contact ring coincided with each other in the plane in which the insulator 2 was in contact with the contact ring. The length (a) of the protruding portion 4 of the insulator member 2 was 10 mm; and the angle of the tapered portion, $\theta_1$, was 10°.

The electroforming solution used had the following composition:

500 g of tetrahydrated nickel sulfamate [$Ni(NH_2SO_3)_2 \cdot 4H_2O$];

35 to 38 g/lit. of monomolecular boric acid ($H_3BO_3$); and 2.5 ml/lit. of an anti-pit agent.

Upon visual observation after the electroforming, no nickel was found to have been deposited on the contact ring; no separation occurred in the interface between the conductive film and the master when the contact ring was being detached from the master.

Further, no cracks had been generated in the conductive film 11.

The thickness of the metal film formed on the conductive film by electroforming was 200±5 μm over a range of 250 mm×300 mm except for the film portion in the vicinity of the contact ring; thus a satisfactory level of film thickness distribution was obtained, except that the thickness of the film portion near the contact ring was diminished.

EXAMPLES 2 to 4

Electroforming was performed in the same way as in Example 1 except that the angle of the tapered portion of the insulator member 2, $\theta_1$, was varied as: 5°, 15° and 30°. An examination was carried out to check whether any nickel deposition had occurred on the contact ring; whether an interface separation occurred between the conductive film and the master when the contact ring was detached from the master; and whether any cracks had been generated in the conductive film. Further, measurement was performed on the thickness distribution of the metal film portion deposited over the range of 250 mm×300 mm except for the film portion in the vicinity of the contact ring. The results of the examination and measurement are given in Table 1. Comparative Example 1.

Electroforming was performed in the same manner as in Example 1 except that the thickness of the contact ring (=the distance (d) between the conductive film 11 and the interface between the insulator member 2 and the contact ring 18) was 10 mm. The resulting metal film was evaluated in the same way as in Example 1.

The evaluation results are given in Table 1.

TABLE 1

| Example | 2 | 3 | 4 | Comp. Ex. 1 |
|---|---|---|---|---|
| Nickel adhesion to contact ring | A | A | B | C |
| Conductive-film/master separation | A | A | A | B |
| Metal-film-thickness distribution | ±5 μm | ±5 μm | ±5 μm | ±5 μm |
| Crack generation in conductive film | A | A | A | A |

Evaluation Criteria:
Adhesion to contact ring:
A: no adhesion
B: local adhesion
C: overall adhesion
Interface separation:
A: not occurred
B: occurred
Crack generation:
A: none
B: some

EXAMPLE 5

A glass master was prepared in the same way as in Example 1. Then, a nickel film was formed to a thickness of 1000 Å by sputtering to form a conductive film 11 on the glass master 6.

In the subsequent electroforming process, the master 6, on which the conductive film 11 had been formed, was held by a master holder 15 as shown in FIG. 3(A) and, while it was being turned in the nickel-sulfamate electroforming solution 7 used in Example 1, at a revolving speed of 20 to 30 rpm, electricity was supplied to the solution in a time-integrated current supply amount of 160 to 240 AH (ampere·hour), thereby depositing nickel to a thickness of 200 to 300 μm to form a metal film 12.

The contact ring used in this example was the same as that in Example 1. An insulator sheet 16 of hardened vinyl chloride having a thickness of 1 mm was used. The insulator sheet 16 had an opening of 276×316 mm and a protruding portion 4 whose length (b) was 6 mm. As a means for retaining the insulator sheet 16 in position, a cover of an insulator material was used, which had a thickness of 20 mm. The cover had an opening which was in contact with the insulator sheet 16 and which had a size of 290×330 mm; further, the cover had a tapered portion whose angle $\theta_2$ was 45°.

Upon observation after the electroforming, a film-formation-rate distribution effect was recognized, and no nickel was found to have been deposited on the contact ring; no separation occurred in the interface between the conductive film and the master when the contact ring was being detached from the master. Upon measurement, the thickness of the metal film formed by electroforming was 200±5 μm over a range of 250 mm×300 mm; thus a satisfactory film-thickness distribution was obtained.

Further, no cracks had been generated in the conductive film 11.

EXAMPLE 6

Photoresist (trade name: AZ-1300, 4.6 cp, manufactured by Hoechst Japan) was applied to a donut-shaped glass substrate having a thickness of 5 mm, an outer diameter of 125 mm and an inner diameter of 30 mm, to a thickness of 1200 Å by means of a spin coater. Afterwards, pre-baking was performed under the conditions of 30 minutes and 90° C.

Subsequently, the tracking groove pattern (groove width: 0.6 μm; pitch: 1.6 μm) of an optical disc was exposed by means of a laser exposure apparatus, and developed by using a developing solution (trade name: Az312MIF manufactured by Hoechst Japan). Then, after-baking was performed under the conditions of 30 minutes at 120° C., thereby forming a photoresist pattern 8' of tracking grooves. In this way, a master 6 for optical discs was prepared. Afterwards, a nickel film was deposited by sputtering to a thickness of 1000 Å, thereby forming a conductive film 11.

In the subsequent electroforming process, the master 6, on which the conductive film 11 had been formed, was held by a master holder 15 as shown in FIG. 2 and, while it was being turned in a nickel-sulfamate electroforming solution 7 at a revolving speed of 20 to 30 rpm, electricity was supplied to the solution in a time-integrated current supply amount of 17 to 34 AH (ampere·hour), thereby depositing nickel to a thickness of 100 to 200 μm to form a metal film 12.

The contact ring used in this example had an outer diameter of 35 mm and a thickness of 0.3 mm. The distance (d) between the surface of the conductive film 11 and the interface between the insulator member 2 and the conductor member 19 was 0.5 mm.

Further, the insulator member 2 had an outer diameter of 55 mm and a thickness of 20 mm. The outer peripheral portion of the insulator member 2 was tapered such that its outer diameter coincides with the outer diameter of the contact ring in the plane in which it is in contact with the contact ring. The length (a) of the protruding portion 4 of the insulator member 2 was 10 mm; and the angle of the tapered portion, $\theta_2$, was 10°.

Upon observation after the electroforming, a film-formation-rate-distribution effect of the insulator member 2 was recognized, and no nickel was found to have been deposited on the contact ring; no separation occurred in the interface between the conductive film and the master when the contact ring was being detached. The thickness of the metal film formed was 200±7 μm over a range as defined by an outer diameter of ϕ120 mm and an inner diameter of ϕ55 mm; thus a satisfactory film-thickness distribution was obtained.

COMPARATIVE EXAMPLE 2

Electroforming was performed in the same manner as in Example 5 except that the insulator sheet 16 was eliminated, with the cover 20 being directly placed on the contact ring 18.

In the electroforming process, the master 6 was turned, as in Example 1, in a nickel-sulfamate electroforming solution 7 at a revolving speed of 20 to 30 rpm, with electricity being supplied to the solution in a time-integrated current-supply amount of 160 to 240 AH (ampere·hour), thereby depositing nickel to a thickness of 200 to 300 μm to form a metal film 12.

Upon observation after the electroforming, some nickel was found to have been deposited on the contact ring to firmly adhere thereto, with the result that the conductive film 11 was separated from the master 6 when the contact ring was being detached from the master.

COMPARATIVE EXAMPLE 3

Figure 10:
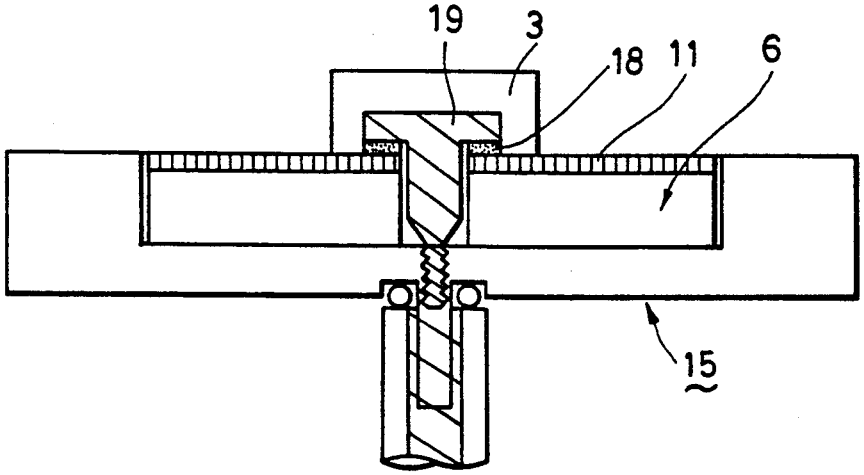
FIG. 10 PRIOR ART
FIG. 10 is a schematic diagram showing a conventional master holder whose contact ring and conductor member are covered with a non-conductor material.

Electroforming was performed in the same way as in Example 6 except that the insulator member 2 was not provided, with those portions of the contact ring 18 and the conductor member 19 which are exposed to the electroforming solution being completely covered with a non-conductor material 3, as shown in FIG. 10. Upon visual observation after the electroforming, it was found that the thickness of those portions of the deposited metal film 12 which were in contact with the non-conductor material was relatively large, and that cracks had been generated in the sections of the conductive film 11 corresponding to those large-thickness portions of the metal film 12.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A master holder in a stamper electroforming apparatus for electroforming a metal film on a conductive film provided on a master having on its surface a minute relief pattern, said master holder comprising: a contact ring for electrically connecting said conductive film to a power source to effect said electroforming and a means provided on said contact ring to control the rate for forming said metal film.

2. A master holder according to claim 1, wherein said contact ring is in contact with an outer edge portion of said conductive film and has an opening at its center; and wherein an insulator member serving as said means for controlling the metal-film-formation rate is provided on said contact ring, said insulator member has at its center an opening which is smaller than said opening of said contact ring, wherein said center of said insulator member coincides with said center of said contact ring.

3. A master holder according to claim 2, wherein a portion of said insulator member in the vicinity of its opening has a tapered sectional configuration, wherein the width of said opening increases in a depth direction toward said contact ring.

4. A master holder according to claim 3, wherein an angle $\theta_1$ defined by the tapered portion of said insulator member and the interface between said contact ring and said insulator member is 5° to 30°.

5. A master holder according to claim 3, wherein the maximum opening of said insulator member in said tapered portion has the same size and contour as said opening of said contact ring.

6. A master holder according to claim 2, wherein said insulator member consists of an insulator sheet.

7. A master holder according to claim 2, wherein the contour of the opening of said insulator member is the same as that of the opening of said contact ring.

8. A master holder according to claim 2, wherein a length (a) of a protruding portion of said insulator member is 5 to 30 mm.

9. A master holder according to claim 1, wherein said insulator member is formed above said contact ring with a conductor member therebetween.

10. A master holder according to claim 2, wherein a length l, which is the distance between the surface of said conductive film and the interface between said insulator member and said contact ring, is 1 mm or less.

11. A master holder according to claim 10, wherein the range of said length l is determined as: 0.05 mm $\leqq l \leqq 0.5$ mm.

12. A master holder according to claim 6, wherein a length l, which is the distance between the surface of said conductive film and the interface between said insulator sheet and said contact ring, is 1 mm or less.

13. A master holder according to claim 12, wherein the range of said length l is determined as: 0.05 mm $\leqq l \leqq 0.5$ mm.

14. A master holder according to claim 6, wherein a length (b) of a protruding portion of said insulator sheet is 5 to 15 mm.

15. A master holder according to claim 1, wherein said contact ring is in contact with an inner edge portion of said conductive film and wherein an insulator member protruding outwardly beyond said contact ring and serving as said film-formation-rate control means is provided on said contact ring.

16. A master holder according to claim 15, wherein the outer contour of said insulator member is the same as that of said contact ring.

17. A master holder according to claim 15, wherein the portion of said insulator member protruding beyond said insulator member has a tapered sectional configuration, wherein its outside dimension decreases in a depth direction toward said contact ring.

18. A master holder according to claim 17, wherein an angle ($\theta_1$) defined by the tapered portion of said insulator member and the interface between said contact ring and said insulator member is 5° to 30°.

19. A master holder according to claim 17, wherein the minimum outside dimension of said insulator member is the same as the outer dimension of said contact ring.

20. A master holder according to claim 15, wherein a length (a) of the protruding portion of said insulator member is 5 to 30 mm.

21. A master holder according to claim 15, wherein said insulator member is formed above said contact ring with a conductor member therebetween.

22. A master holder according to claim 15, wherein a length l, which is the distance between the surface of said conductive film and the interface between said insulator member and said contact ring, is 1 mm or less.

23. A master holder according to claim 22, wherein the range of said length l is determined as: 0.05 mm $\leqq l \leqq 0.5$ mm.

24. A master holder according to claim 15, wherein said insulator member consists of an insulator sheet.

25. A master holder according to claim 24, wherein a length l, which is the distance between the surface of said conductive film and the interface between said insulator film and said contact ring, is 1 mm or less.

26. A master holder according to claim 25, wherein the range of said length l is determined as: 0.05 mm $\leqq l \leqq 0.5$ mm.

27. A master holder according to claim 24, wherein a length (b) of the protruding portion of said insulator sheet is 5 to 15 mm.

28. A master holder in a stamper electroforming apparatus for electroforming a metal film on a conductive film provided on a master having on its surface a relief pattern corresponding to information recorded on an optical recording medium, said master holder comprising: a contact ring for electrically connecting said conductive film to a power source to effect said electroforming; and a means provided on said contact ring to decrease the film formation rate of said metal film in the vicinity of said contact ring.

29. A stamper electroforming method, which comprises electroforming a metal film on a conductive film provided on a master having a minute relief pattern on its surface, wherein said metal film is formed by employing a master holder which comprises: a contact ring for electrically connecting said conductive film to a power source; and a means provided on said contact ring to control the rate for forming said metal film, whereby the thickness of said metal film gradually decreases in the direction of said contact ring.

30. A master holder according to claim 9, wherein said insulator member consists of an insulator sheet.

31. A master holder according to claim 9, wherein a length l, which is the distance between the surface of said conductive film and the interface between said insulator member and said conductor member, is 1 mm or less.

32. A master holder according to claim 30, wherein a length l, which is the distance between the surface of said conductive film and the interface between said insulator member and said conductor member, is 1 mm or less.

33. A master holder according to claim 21, wherein said insulator member consists of an insulator sheet.

34. A master holder according to claim 21, wherein a length l, which is the distance between the surface of said conductive film and the interface between said insulator member and said conductor member, is 1 mm or less.

35. A master holder according to claim 33, wherein a length l, which is the distance between the surface of said conductive film and the interface between said insulator member and said conductor member, is 1 mm or less.

* * * * *

UNITED STATES PATENT AND TRADEMARK OFFICE

CERTIFICATE OF CORRECTION

PATENT NO. : 5,167,792

DATED : December 1, 1992

INVENTOR(S) : HIROFUMI KAMITAKAHARA, ET AL.

It is certified that error appears in the above-identified patent and that said Letters Patent is hereby corrected as shown below:

COLUMN 3

Line 39, "terms" should read --terms of--.
Line 44, "non conductor" should read --non-conductor--.

COLUMN 6

Line 36, "0.05 mm ≦ 0.5 mm." should read --0.05 mm ≦ 1 ≦ 0.5 mm.--.
Line 44, "distance l" should read --distance l--.
Line 65, "opening d" should read --opening (d)--.

COLUMN 7

Line 48, "length 1," should read --length l,--.

COLUMN 9

Line 31, "ring one" should read --ring can be used many times for one--.
Line 33, "of" (first occurrence) should be deleted.
Line 48, "no" should read --not--.
Line 54, "has" should read --had--.

UNITED STATES PATENT AND TRADEMARK OFFICE

CERTIFICATE OF CORRECTION

PATENT NO. : 5,167,792

DATED : December 1, 1992

INVENTOR(S) : HIROFUMI KAMITAKAHARA, ET AL.

It is certified that error appears in the above-identified patent and that said Letters Patent is hereby corrected as shown below:

COLUMN 10

Line 63, "Compara-" should be deleted.
Line 64, "tive Example 1." should read
--Comparative Example 1.--.

Signed and Sealed this

Twenty-second Day of February, 1994

Bruce Lehman

*Attest:*

BRUCE LEHMAN

*Attesting Officer*

*Commissioner of Patents and Trademarks*